United States Patent [19]

Hirashima et al.

[11] Patent Number: 4,466,782

[45] Date of Patent: Aug. 21, 1984

[54] VALVE UNIT FOR USE IN CONCRETE PUMPS

[75] Inventors: Shigeaki Hirashima, Iwatsuki; Shintaro Chida, Gunma, both of Japan

[73] Assignee: Niigata Engineering Co., Ltd., Japan

[21] Appl. No.: 381,707

[22] Filed: May 25, 1982

[30] Foreign Application Priority Data

Jun. 10, 1981 [JP] Japan ..... 56-85315[U]
Sep. 21, 1981 [JP] Japan ..... 56-140210[U]
Sep. 21, 1981 [JP] Japan ..... 56-140212[U]

[51] Int. Cl.[3] ..... F04B 7/00

[52] U.S. Cl. ..... 417/517; 417/532; 417/900

[58] Field of Search ..... 417/900, 516, 517, 518, 417/519, 532; 366/27, 42, 43, 51

[56] References Cited

U.S. PATENT DOCUMENTS 3,298,322 1/1967 Sherrod ..... 417/900 X
3,667,869 6/1972 Schlecht ..... 417/900 X
4,198,193 4/1980 Westerlund et al. ..... 417/900 X
4,343,598 8/1982 Schwing et al. ..... 417/900 X
4,382,752 5/1983 Schlecht ..... 417/900 X

FOREIGN PATENT DOCUMENTS 1917718 11/1980 Fed. Rep. of Germany ..... 417/900

*Primary Examiner*—Carlton R. Croyle
*Assistant Examiner*—Donald E. Stout
*Attorney, Agent, or Firm*—Kane, Dalsimer, Kane, Sullivan and Kurucz

[57] ABSTRACT

A fluid passage change over valve unit for use in concrete pumps wherein a passage change over valve member located within a hopper is connected at its outlet port to a delivery line for pivoting about the latter so that an inlet port thereof is swung to alternately communicate with a pair of piston pumps having pump openings into the hopper. The valve unit is provided with a pair of guide members disposed along both sides of the valve member. One end of each guide member opens upwards and the other end is disposed to come into alignment with the opening of corresponding one of the piston pumps for guiding a fluid concrete within the hopper to the one pump when the valve member communicates with the other pump.

13 Claims, 17 Drawing Figures

VALVE UNIT FOR USE IN CONCRETE PUMPS

BACKGROUND OF THE INVENTION

The present invention relates to a fluid passage change over valve unit for use in concrete pumps which pump freshly-mixed or ready-mixed concrete to a casting or deposite site such as building or construction site.

FIG. 1 illustrates a typical well-knonw concrete pump. The concrete pump comprises a hopper 1 into which a ready-mixed concrete A is fed, a pump unit having a pair of piston cylinders 3 and 4 which are mounted to a rear wall 2 of hopper 1 to communicate to the inside of hopper 1 and perform the intake and discharge of fluid concrete A, and a valve unit for changing over a fluid passage from the pump cylinders 3 and 4 to a delivery line (not shown) which leads to a deposite site, the valve unit having a pivotal valve pipe 5, one end of which is connected to the delivery line for pivoting about the latter and the other end of which is pivoted for alternate communication with the pump cylinders 3 and 4.

In the prior concrete pump, for example, the retraction of a piston of one cylinder 4 causes the concrete A to be drawn into that cylinder. The swinging pipe 5 is then moved into engagement with the charged cylinder 4 and the piston is extended to force the concrete through the swing pipe 5 and into the delivery line. During such operation, the other cylinder 3 is filling with the fluid concrete A for subsequent discharge into valve pipe 5 during the charging of the first cylinder 4. In such manner, the swing pipe 5 alternately connects to the cylinders 3 and 4, whereby the fluid concrete A is pumped from hopper 1 through swing pipe 5 and delivery line to a deposit site.

Such conventional concrete pump has the following drawbacks. Usually, swing pipe 5 is instantaneously switched and hence it is necessary to move, in quick response to the switching of pipe 5 a large amount of fluid concrete A within hopper 1 toward the opening of cylinder 3 or 4 which is to be filled with the fluid concrete for facilitating the drawing of the concrete into the cylinder. However, when the ready-mixed concrete within the hopper 1 is of a low slump, it cannot follow the quick swinging motion of pipe 5 since the concrete is fed to the cylinders 3 and 4 by gravity, and thus a vacuum portion is momentarily formed around the opening of cylinder 3 or 4 which is out of communication with swinging pipe 5 as shown by a dot and dash line in FIG. 2. This can separate the fluid concrete into cement paste and aggregate. Furthermore arches of the fluid concrete can be formed above the openings of cylinders 3 and 4 within hopper 1 as at 8 in FIG. 2, with the result that the concrete at the arch 8 is prevented from dropping down and from being fed to the opening. In addition, air passages from the openings of cylinders 3 and 4 to the atmosphere can be formed in the fluid concrete A within hopper 1, which causes air to be drawn in the cylinders 3 and 4 during their intake stroke. Such drawbacks will reduce the intake of concrete A into cylinders 3 and 4, and hence lower the transfer efficiency of the concrete pump. Not only for low slump concrete but also for fluid concrete which is liable to be separated into cement paste and aggregates, the ready-mixed concrete A which is fed to the cylinders 3 and 4 can be substantially restricted to two funnel-shaped portions in the concrete A which extend upwardly from the openings of pump cylinders 3 and 4 respectively, with the result that funnel-shaped air passages are formed, communicating the openings to the atmosphere. Thus, the remainder of the fluid concrete A can not be drawn in cylinders 3 and 4 and further the cement paste and aggregates of the concrete A can be separately drawn in the cylinders. These disadvantages can cause reduction in intake efficiency of the fluid concrete into the pump cylinders and the choking of the swing pipe 5 or the delivery line due to the pumping of only aggregate component.

To overcome the above disadvantages there has been proposed a concrete pump having an agitator 6 with paddles 7 as shown in FIG. 2, the agitator 6 being usually disposed within hopper 1 above the openings of cylinders 3 and 4. The rotation speed of paddles 7 is restricted to a speed much smaller than that of swinging pipe 5 because increase in speed of paddles 7 beyond the limited speed will produce a considerable loss of power, separation of the concrete into cement paste, aggregates, etc., and thus it is impracticable to feed a large amount of the ready-mixed concrete A by paddles 7 to the cylinder openings in quick response to swing motion of valve pipe 5, with the result that agitator 6 cannot sufficiently eliminate the disadvantages at least in a low slump concrete. In addition, the agitator paddles 7 are likely to block instantaneous movement of fluid concrete A of a low slump whereby the disadvantages can be enlarged.

Further, when valve pipe 5 is pivoted, it forces adjacent fluid concrete toward and substantially perpendicularly to the side walls of hopper 1, so that valve pipe 5 can hold the fluid concrete against the side walls if the fluid concrete A is largely separated and contains a relatively large proportion of aggregates, and thus the switching of valve pipe 5 can be adversely affected or cannot be performed at its worst.

SUMMARY OF THE INVENTION

Accordingly, it is an object of the present invention to provide a fluid passage change over valve unit for concrete pumps which in accordance with the quick change motion of the valve can agitate homogeneously fluid concrete at locations within a hopper where the fluid concrete is liable to be separated and the arches of the concrete or air passages through the concrete may be formed, whereby such drawbacks can be eliminated or at least reduced, and thus intake efficiency of the concrete pump can be enhanced and the choke up of the pivotal valve pipe and delivery line can be prevented.

It is another object of the present invention to provide a fluid passage change over valve unit for concrete pumps which can easily draw fluid concrete within the hopper in pumps by the use of gravity, and the concrete can be smoothly fed to the pump cylinders due to the high stability of the flow of the concrete thereto, whereby the concrete can be transferred without separation thereof and the intake efficiency of the pumps can be also improved from this point.

It is a further object of the present invention to provide a fluid passage change over valve unit in which the change over valve is prevented from holding fluid concrete against the hopper walls, thereby ensuring smooth switching of the change over valve.

These and other objects in view the present invention provide a fluid passage change over valve unit for concrete pumps wherein a passage change over valve member located within a hopper is connected at its outlet port to a delivery line for pivoting about the latter so that an inlet port thereof is swung to alternately communicate with a pair of pumps having pump openings into the hopper, the improvement which comprises a pair of guide members disposed on both sides of the passage change over valve one end of each said guide member opening upwardly and the other end being disposed to come into alignment with the opening of corresponding one of the pumps for guiding the concrete within the hopper to the one pump when the change over valve member communicates with the other pump.

BRIEF DESCRIPTION OF THE DRAWINGS

While the specification concludes with claims which particularly point out and distinctly define the subject matter which is regarded as the invention, it is believed the invention will be more clearly understood from the following detailed description and the accompaning figures of the drawings, in which the same or similar members are designated by the same reference number. In the drawings:

FIG. 12 (B) is a view in the direction of the arrow XII in FIG. 12 (A);

DESCRIPTION OF THE PREFERRED EMBODIMENTS

Figure 1:
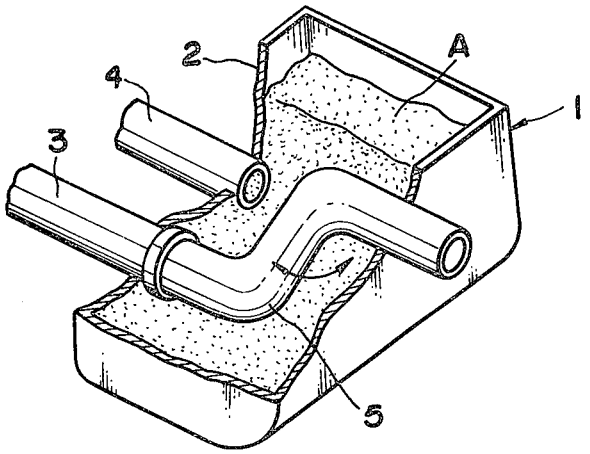
FIG. 1 (PRIOR ART)
FIG. 1 is a cut away view in perspective of the prior concrete pump.
Figure 2:
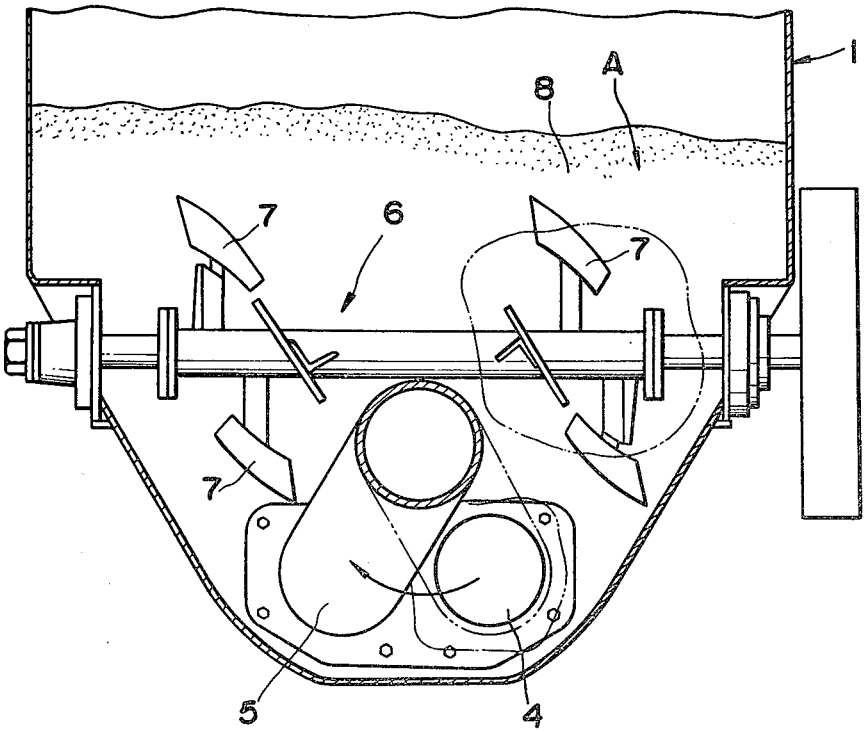
FIG. 2 (PRIOR ART)
FIG. 2 is a vertical section of the concrete pump in FIG. 1.
Figure 3:
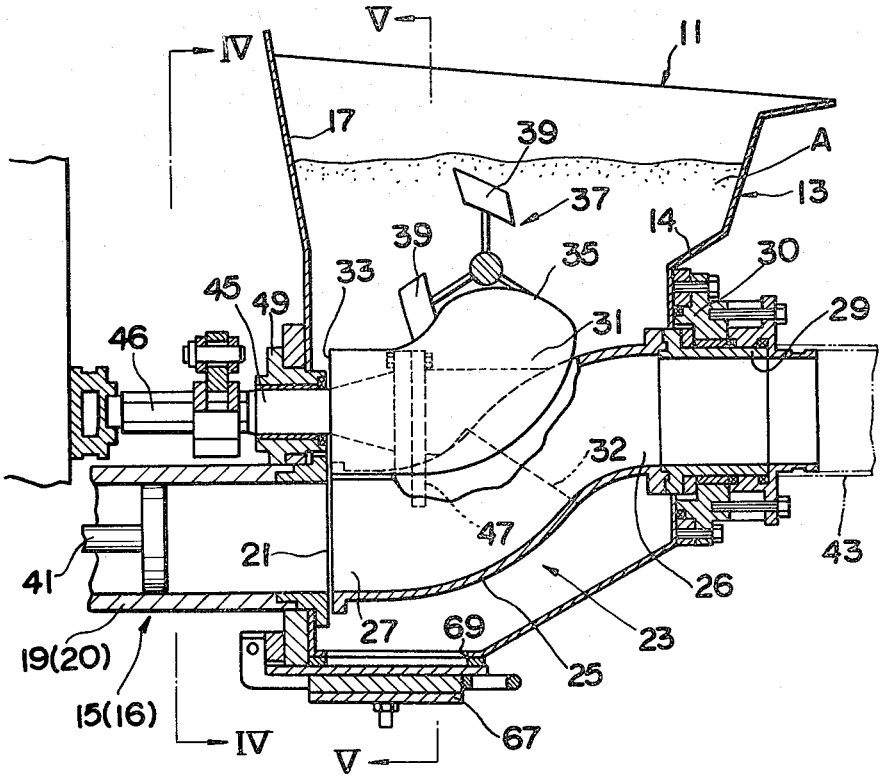
FIG. 3 is a sectional side view of a concrete pump according to the present invention.
Figure 4:
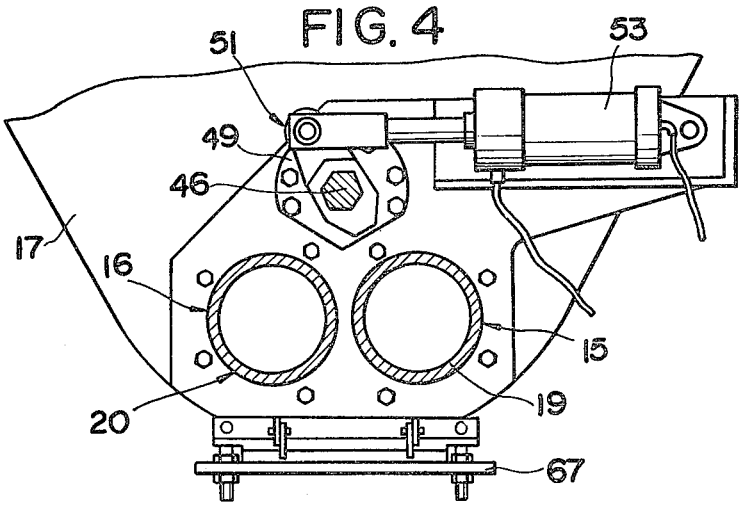
FIG. 4 is a fragmentary view taken along the line IV—IV in FIG. 3.
Figure 5:
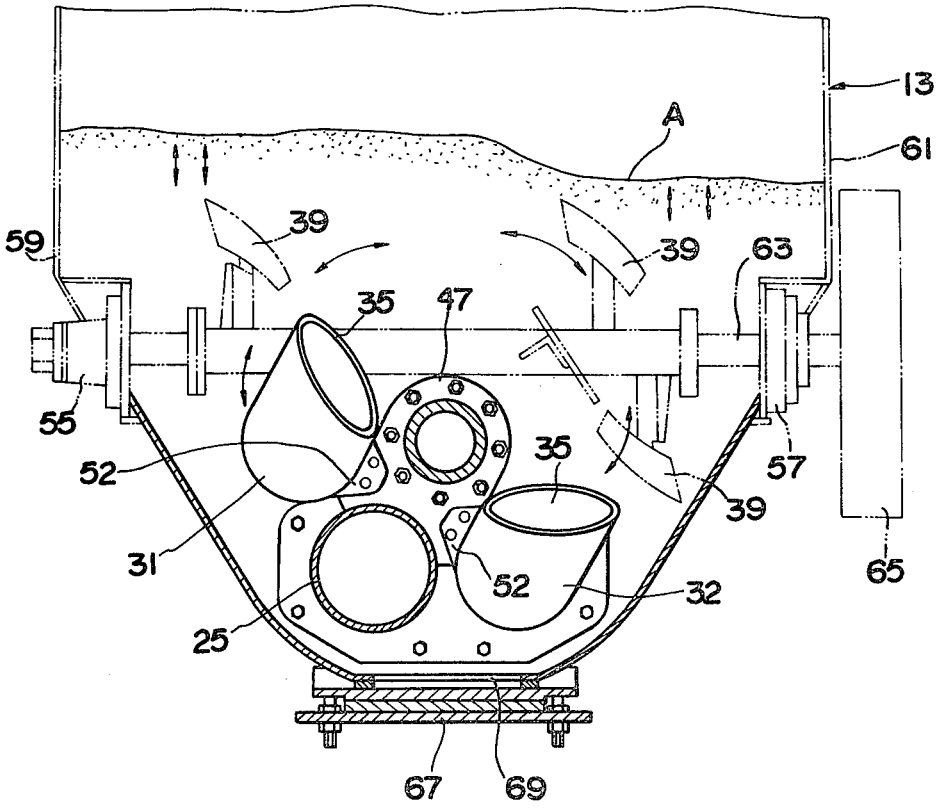
FIG. 5 is a vertical section taken substantially the line V—V in FIG. 3.

Referring to FIGS. 3 to 5, there is illustrated one embodiment of the invention, in which reference numeral 11 indicates a concrete pump. The concrete pump 11 generally comprises: a hopper 13 into which a freshly-mixed concrete or ready-mixed concrete A is fed; a pair of piston pumps 15 and 16 which are fixedly attached in a suitably spaced relationship to the lower portion of the rear wall 17 of the hopper 13 to communicate open ends 21 of pump cylinders 19 and 20 to the inside of hopper 13; a fluid passage change over valve unit 23 having a swinging pipe 25 as a valve member of which one end or outlet port 26 is connected to a supporting pipe 29 supported through a bearing 30 to the front wall 14 of hopper 13 so that it can be pivoted about supporting pipe 29, and of which the other end or inlet port 27 is swung to alternately communicate with open ends 21 of pump cylinders 19 and 20; and a pair of guide pipes 31 and 32 as guide members disposed on both sides of pivotal pipe 25 so that one end or discharge end 33 of each guide pipe faces corresponding open end 21 of pump cylinders 19 and 20 when pivotal pipe 25 communicates with the other open end 21, the other end or intake end 35 of each guide pipe opening upwards toward the inlet of hopper 13.

Figure 6:
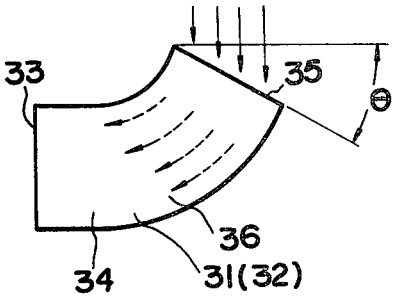
FIG. 6 is a side view of the guide pipe in FIG. 3.

Within cylinders 19 and 20, there is reciprocatably disposed each a piston 41 which is drived between an extended position near the open end 21 thereof and a retracted position by a conventional drive means (not shown), i.g., hydraulic drive device, and thereby in synchronism with swinging pipe 25 draws fluid concrete A into one cylinder 19 or 20 and simultaneously forces concrete A charged in the other cylinder 20 or 19 into swinging pipe 25. The swining pipe 25 is of substantially a crank shape. One end or outlet port 26 of pipe 25 is connected through supporting pipe 29 to a delivery line 43 leading to a casting site, the supporting pipe 29 being disposed above the level of piston pumps 15 and 16. Further, to the other end or inlet port 27 of pivotal pipe 25 there is coupled a pivotal shaft 45 through a joint plate 47 welded or fixedly attached to the other end 27. The pivotal shaft 45 is rotatably supported on a bearing 49 fixedly secured to the back wall 17 of hopper 13 such that the shaft 45 is coaxial with supporting pipe 29, the pivotal shaft 45 passing through the wall 17. The outer end 46 of pivotal shaft 45 is coupled through a crank member 51 to a suitable driving means such as hydraulic cylinder 53 fastened to the outer surface of back wall 17, and thus by the actuation of hydraulic cylinder 53 swinging pipe 25 is pivoted about pivotal shaft 45 resting on bearing 49. The pair of guide pipes 31 and 32 which are disposed on both sides of swinging pipe 25 each have a lug 52 as shown in FIG. 5 projecting radially outwardly from the outer surface thereof and are attached to joint plate 47 by fastening the lugs 52 with bolts and nuts to that joint plate so that the discharge ends 33 of guide pipes 31 and 32 and the inlet port 27 of pivotal pipe 25 are arranged on a circle with center at the axis of pivotal shaft 45 or supporting pipe 29. As shown in FIG. 6, guide pipes 31 and 32 each include a straight portion 34 and a bent portion 36 extending arcuately from straight portion 34. The open angle $\theta$ of intake end 35 with horizontal plane may be appropriately defined, and is preferably $0° \leqq \theta \leqq 60°$. The guide pipes 31 and 32 extend, as shown in FIG. 3, substantially in parallel with swinging pipe 25, so that intake ends 35 thereof open upwardly. In addition, an agitator 37 having a plurality of agitator paddles 39 is disposed horizontally within hopper 13. The agitator paddles 39 project, as shown in FIG. 5, radially in spaced relationship from an agitator shaft 63 of which the opposite ends rest on bearings 55 and 57 fixedly secured to opposite sidewalls 59 and 61, respectively. One end of agitator shaft 63 passes through sidewall 61, on which end is fixedly mounted a chain sprocket wheel 65 drived by a suitable driving means (not shown) to rotate agitator shaft 63, and thereby to mix ready-mixed concrete A with paddles 39. To the bottom of hopper 13 there is hinged a swing open bottom cover 67 to open and close a bottom opening 69 thereof.

In operation, swinging pipe 25 is aligned with either cylinders 19 or 20. Thus, assuming alignment of swinging pipe 25 with cylinder 19 as shown in FIGS. 3 and 5, after freshly-mixed concrete A is drawn into and fills the other cylinder 20 of pump 16 through guide pipe 32 by retracting piston 41 thereof, hydraulic cylinder 53 is actuated to turn pivotal shaft 46 through crank 51 in one direction so that pivotal pipe 25 is pivoted about connecting pipe 29 until intake end 27 thereof comes into alignment with the open end 21 of the charged cylinder 20, with the result that cylinder 20 communicates with delivery line 43 through pivotal pipe 25. The guide pipe 32 which previously communicated with cylinder 20 is now moved upwardly to a position above the cylinder according to the switching movement of pivotal pipe 25 while mixing adjacent fluid concrete A in hopper 13. On the other hand, the opposite guide pipe 31 is simultaneously moved so that the discharge end 33 thereof faces open end 21 of cylinder 19 of the other pump 15. Simultaneously with or just after the alignment of pivotal pipe 25 and guide pipe 31 with pump cylinders 20 and 19, respectively, piston pump 16 is actuated to extend piston 41 thereof, thereby forcing the fluid concrete charged within the cylinder 20 outwardly through swinging pipe 25 into transfer pipe 43. During the pumping stroke of pump 16, the opposite pump 15 is actuated to retract piston 41 therein, thereby drawing fluid concrete contained within hopper 13 through guide pipe 31 into cylinder 19. At the end of the pumping stroke of piston pump 16, the other piston pump 15 is competely filled with concrete A. The pipe 25 is then rapidly switched back to alignment with cylinder pump 15, and guide pipe 32 comes into alignment with cylinder pump 16. During this switching motion of pivotal pipe 25 guide pipe 31 is moved upwardly to a position above cylinder 19, while mixing concrete A within hopper 13. Now, the operation of piston pumps 15 and 16 are reversed to force fluid concrete A from cylinder 19 through pivotal pipe 25 into delivery line 43 and simultaneously fill cylinder 20 with fluid concrete through guide pipe 32. This cycle continues and maintains a continuous flow of freshly-mixed concrete through delivery line 43 to a deposit site.

During this pumping operation, the guide pipes 31 and 32 which are pivoted together with pivotal pipe 25 performs, as indicated generally by the arrows in FIG. 5, complicated mixing of ready-mixed concrete A which lies at the place above pivotal pipe 25 where the arches and separation of fluid concrete and air passages are liable to be formed, whereby such drawbacks are sufficiently removed and thus the efficiency of concrete transfer is highly improved. In this mixing, fluid concrete A which lies adjacent the swinging locus of pivotal pipe 25 is raised upwards by the swinging of guide pipes 31 and 32 and hence the pivotal valve 25 is prevented from holding the concrete A against the hopper walls, so that smooth switching of pivotal valve 25 is ensured.

Generally, freshly-mixed concrete is highly viscous and poor in fluidity as compared to water, oil and the like and at its worst it can separate into cement paste and aggregates. For these reasons, the conventional concrete pump which draws a fluid concrete from a hopper laterally into the cylinder has a poor intake efficiency of the fluid concrete since lateral force exerted by gravity on the concrete is relatively small. According to the present invention, as shown in FIG. 6 guide pipes 31 and 32 of which intake ends open upwards serve to effectively receive freshly-mixed concrete and lead it smoothly to pump openings 21. Thus, the intake efficiency of the pumps 15 and 16 can be highly improved.

Figure 7:
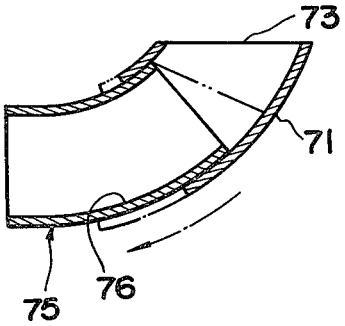
FIG. 7 is an axial section of a modification of the guide pipe.

In FIG. 6, intake ends 35 of guide pipes 31 and 32 open upwardly at a definite angle with horizontal plane. However, such angle of the intake end and the length of the curved portion 36 may be set to be adjustable as shown in FIG. 7, in which an arcuately curved slide pipe 71 one end of which forms an intake end 73 is slidably fitted around the correspondingly curved portion 76 of guide pipe 75. The slide pipe 71 is slided to one of predetermined positions on curved portion 76 and fastened there by suitable means such as bolts and nuts, whereby a suitable open angle and length of curved portion of the guide pipe can be set. Alternatively, the guide pipe may be selected from a several number of previously prepared pipes which are different in the open angle and length of the curved portion thereof. These adjustments of the open angle and length of the curved portion of the guide pipe enable the maintaining of constant intake efficiency of the cylinder pumps irrespective of change in the slump of concrete. Further, the straight portion 34 of the guide pipes may be replaced by a curved or bent one.

Figure 8:
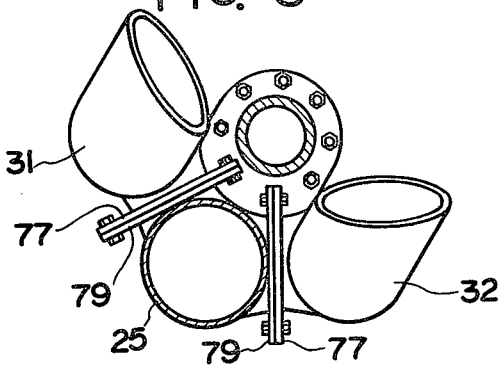
FIG. 8 is a front elevation partly in section of the valve unit in FIG. 3.

The guide pipes 31 and 32 may be formed integrally with pivotal pipe 25 or as in FIG. 8 they may be each removably attached to pipe 25 by bolting together a joint plate 77 integrally formed therewith and a joint plate 79 integrally formed with swing pipe 25.

Figure 9:
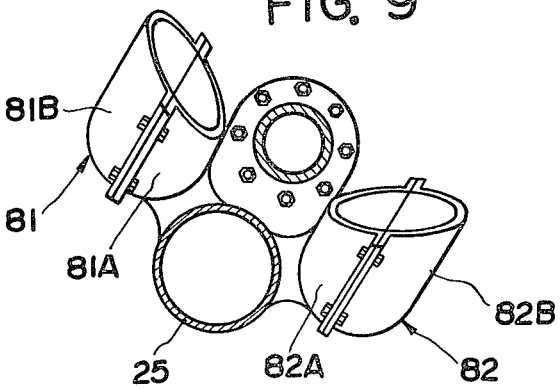
FIG. 9 is a front elevation partly in section showing another modification of the guide pipe.

Further, as shown in FIG. 9, guide pipes 81 and 82 may be each divided into two halves 81A and 81B or 82A and 82B. The halves 81A and 82A are integrally formed with or welded to pivotal pipe 25. The other two halves 81B and 82B are bolted removably to halves 81A and 82A respectively to form guide pipes 81 and 82. This detachable construction is useful for washing the inside of hopper 13 and guide pipes 81 and 82.

Figure 10:
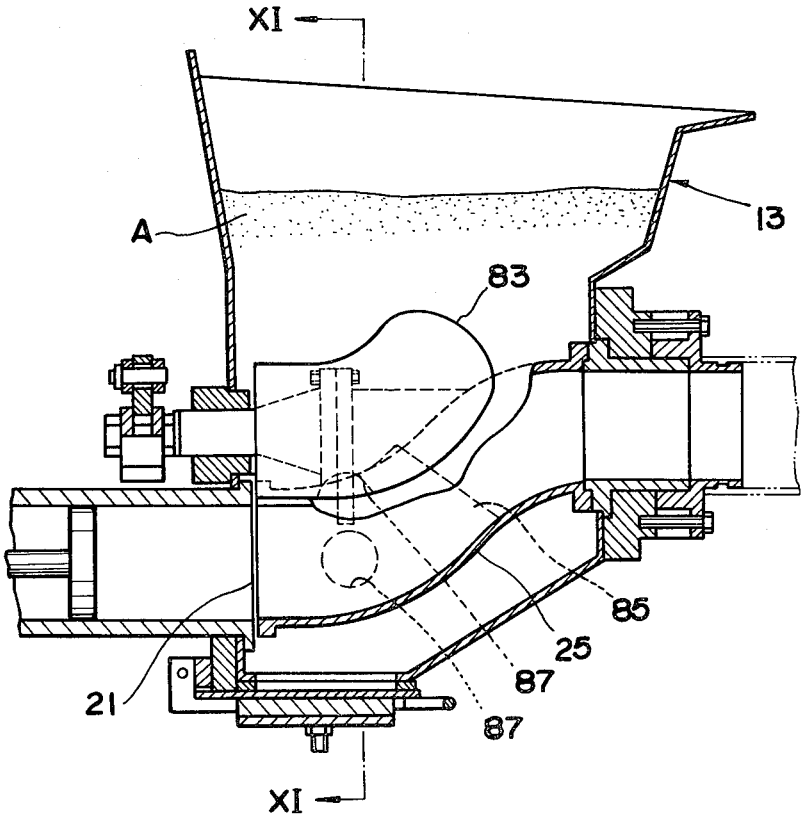
FIG. 10 is a sectional side view of a concrete pump utilizing still another modification of the guide pipe.
Figure 11:
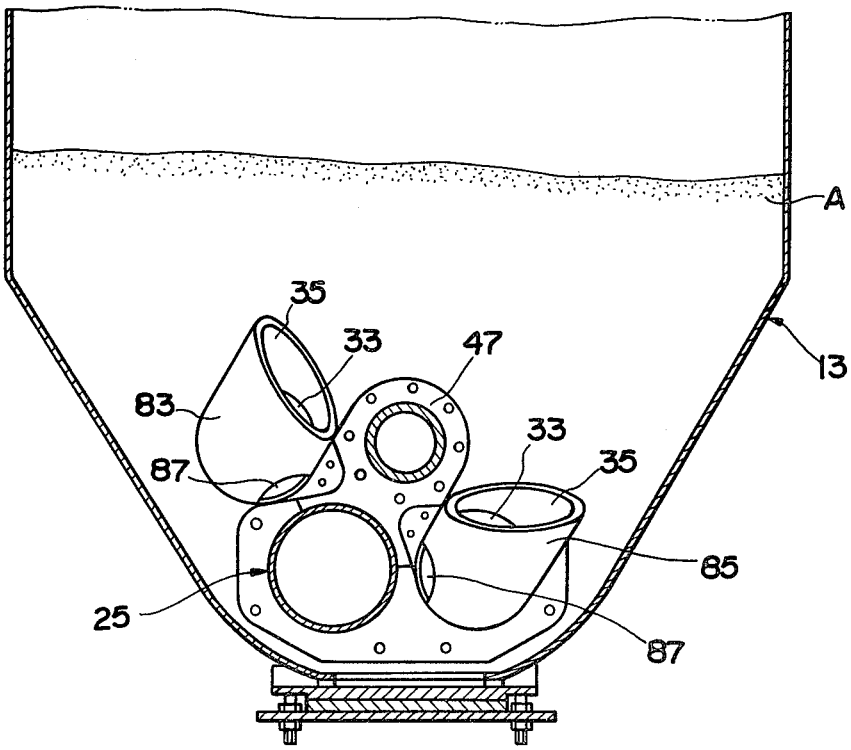
FIG. 11 is a vertical section substantially taken along the line XI—XI in FIG. 10.

In FIGS. 10 and 11, there is illustrated another modification of guide pipes 83 and 85, which have each a circular opening 87 formed through walls thereof to face pivotal pipe 25, the opening 87 communicating the inside of guide pipes 83 and 85 to that of hopper 13. When the washing of guide pipes 83 and 85 is performed by reversing the piston stroke of cylinder pumps 15 and 16, fluid concrete is injected from piston cylinders 19 and 20 into guide pipes 83 and 85 where it is scattered through openings 87 out of guide pipes 83 and 85 by the swinging motion of the pipe 25, whereby time and labor required for the washing can be largely reduced. The requirements for opening 87 are as follows. It is essential to locate opening 87 so that it may not face or open toward the bottom of hopper 13 for preventing fluid concrete from flowing out of opening 87 back to hopper 13 when guide pipes 83 and 85 communicates with respective cylinders 19 and 20 in the pumping of fluid concrete. Further, the opening 87 is preferably formed to open toward the bottom of hopper 13 for preventing the introduction of fluid concrete A therethrough into guide pipes 83 and 85 when the guide pipes 83 and 85 are out of communication with cylinders 19 and 20. For these reasons the position of washing opening 87 is suitably determinded so that it may face pivotal pipe 25 as in FIGS. 10 and 11. The diameter of opening 87 must not be larger than about 100 mm and is preferably about 80 mm for guide pipe of about 180 mm diameter. Beyond the upper limit, i.e., about 5/9 of the diameter of the guide pipe, fluid concrete considerably flows through the opening 87 back to hopper 13 or into the guide pipes 83 and 85 through that opening. These facts will adversely affect the transportation and the composition of the fluid concrete. The position and size of the washing opening 87 may be suitably varied in view of the diameter and swing travel of guide members 83 and 85, the slump of freshly-mixed concrete A, size of aggregates used, etc. Generally, the washing opening 87 is made relatively large in diamer for a large size of aggregates. The shape of opening 87 is not restricted to circle, but may be of any suitable shape.

In washing operation, the functioning of piston pumps 15 and 16 and pivotal valve 25 are reversed. That is, concrete contained in pivotal valve 25 is absorbed in cylinders 19 and 20 and then fed back to hopper 13 through guide pipes 83 and 85, in which event even if any concrete remains in guide pipe 83 or 85 without flowing out of the inlet or discharge ends thereof, it will be scattered out of washing opening 87 into hopper 13 by the pivotal movement of that guide pipe, whereby concrete remained in the guide pipes 83 and 85 can be positively removed therefrom by normal washing operation and hence time required for the washing can be largely reduced.

Figure 12A:
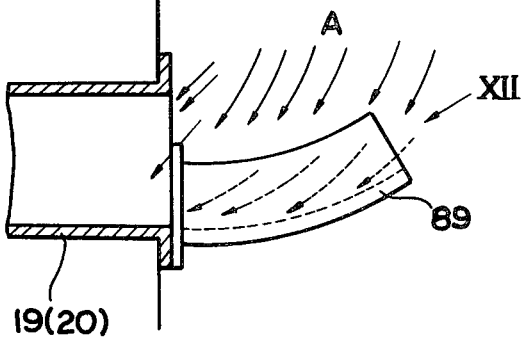
FIG. 12 (A) is a side view of a guide trough used in the present invention.
Figure 12B:
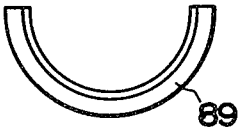
Figure 13:
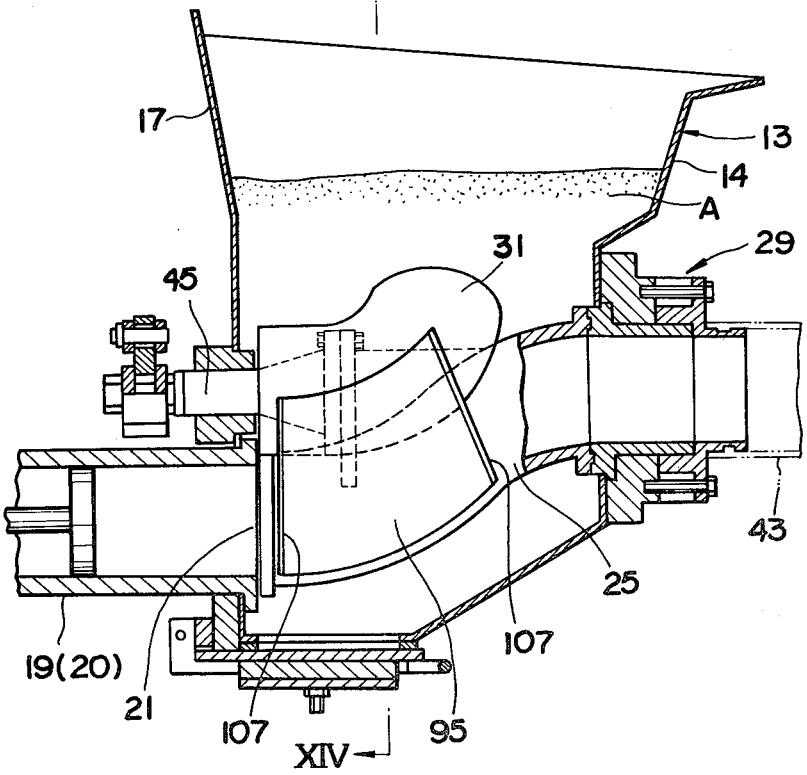
FIG. 13 is a sectional side view of a concrete pump utilizing a futher modification of the valve unit.

As shown in FIGS. 12(A) and 12(B), the guide member may be of a trough shape having an arcuate section and slightly curved upwards in its longitudinal direction. This guide member 89 achieves a high intake efficiency of fluid concrete substantially of the same level as that afforded by the previously-mentioned guide pipes. The guide member 89 opens upwardly throughout the overall length and hence there is no need to provide the intake angle $\theta$ as in guide pipes 31 and 32 in FIG. 6. As seen from FIG. 12(A), gravity acting on concrete A serves effectively for drawing it in pump cylinders 19 and 20 throughout the overall length of guide trough 89.

Figure 14:
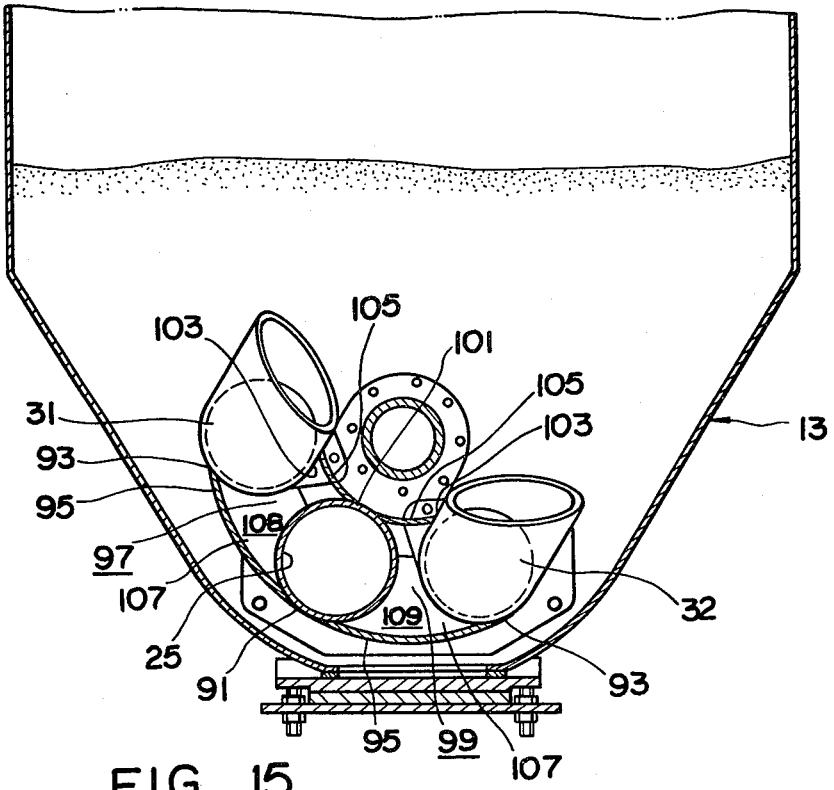
FIG. 14 is a vertical section substantially taken along the line XIV—XIV in FIG. 13.
Figure 15:
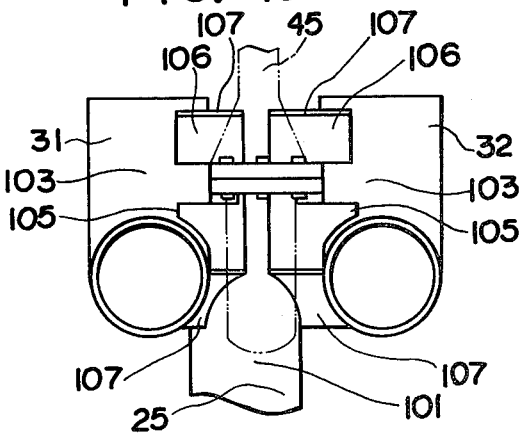
FIG. 15 is a plan view of the valve unit in FIG. 13.
Figure 16:
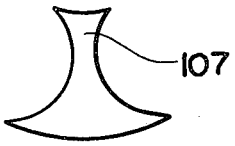
FIG. 16 is a side view of the end closure plate in FIG. 15.

Referring to FIGS. 13 to 16, there is illustrated a still further modification of the valve unit. A lower covering member or plate 95 extends between a portion furthest from the axis of pivotal shaft 45 or lower portion 91 of pivotal pipe 25 and a portion furthest from the axis of pivotal shaft 45 or lower portion 93 of guide pipe 31. Another covering plate 95 extends also between the lower portion 91 of pivotal pipe 25 and that of guide pipe 32. The opposite edges of each covering plate 95 are welded to the lower portions of pipe 25 and guide pipe 31 or 32 in order to cover gaps 97 or 99, the gap 97 being defined by pivotal pipe 25 and guide pipe 31 and the gap 99 by pivotal pipe 25 and the other guide pipe 32. The covering plates 95 have the same curvature as the swinging locus of the lower portion 91 of pivotal pipe 25 or lower portions 93 of guide pipes 31 and 32, and are disposed along that swinging locus so that the covering plates 95 form segments of a circle with center at the pivotal axis of pivotal pipe 25. On the other hand, as shown in FIG. 15, a pair of upper covering plates 105 as upper covering members are disposed between a portion nearest to the axis of pivotal shaft 45 or upper portion 101 of swinging pipe 25 and a portion nearest to the axis of pivotal shaft 45 or upper portion 103 of guide pipe 31 and between that upper portion 101 and the upper portion 103 of guide pipe 32, respectively. Another pair of upper covering plates 106 as upper covering members are also disposed between the upper portion 101 of swinging pipe 25 and the upper portion 103 of guide pipe 31 and between that upper portion 101 and the upper portion 103 of guide pipe 32, respectively. The opposite edges of each of the abovedescribed upper covering members 105 and 106 are welded to the upper portions of pivotal pipe 25 and guide pipe 31 or 32 to cover gaps 97 and 99. Thus, spaces 108 and 109 having opposite open ends are, as shown in FIG. 14, formed between pivotal pipe 25 and guide pipe 31 and between the pivotal pipe 25 and guide pipe 32, respectively. The upper covering members 105 and 106 have each a curved profile of the same curvature as a swing locus of the upper portion 101 of pivotal pipe 25 or the upper portions 103 of the guide pipes 31 and 32 and are provided along that swing locus. Four end closure plates 107 are welded or fixedly attached to the opposite ends of upper and lower covering plates 95, 105 and 106, and thereby the opposite open ends of spaces 108 and 109 are completely water sealed. Thus, the entrance of fluid concrete into these spaces are prevented, which results in that there is no adhesion of concrete to pivotal valve 25 and guide pipes 31 and 32 adjacent the gaps 97 and 99, whereby time and labor necessary for washing the valave unit are largely reduced, and that no shearing resistance of concrete due to the entrance of the fluid concrete into the gaps 97 and 99 is generated. Furthermore, the covering plates 95, 105 and 106 contact fluid concrete A within hopper 13 on the outer surface thereof extending along the abovementioned swing locuses of swing pipe 25, so that the contact resistance of swing pipe 25 and guide pipes 31 and 32 to fluid concrete A can be minimized. These facts will ensure smooth swinging of pivotal valve 25 and guide pipes 31 and 32.

What is claimed is:

1. A fluid passage change over valve unit for concrete pumps of the type wherein a passage change over valve member located within a hopper is connected at its outlet port to a delivery line for pivoting about the latter so that an inlet port thereof is swung to alternately communicate with a pair of piston pumps with pump openings into the hopper, the improvement which comprises a pair of guide members disposed along both sides of the passage change over valve member, one end of each said guide member opening upwards and the other end being disposed to come into alignment with the opening of corresponding one of the piston pumps for guiding concrete within the hopper to said one pump when the change-over valve member communicates with the other piston pump and means for positioning each of said guide members into alignment with the opening of the corresponding piston pump when the valve member communicates with the other piston pump.

2. A fluid passage change over valve unit as recited in claim 1, wherein said valve member is of a substantially hollow crank shape and each said guide member is a pipe comprising a straight portion having a discharge end to the pump cylinder and a curved portion having an intake end and extending upwardly from said straight portion.

3. A fluid passage change over valve unit as recited in claim 2, wherein said intake end has an opening defining a plane which is at an angle of about 0° to 60° with respect to the horizontal plane.

4. A fluid passage change over valve unit as recited in claim 2 or 3, wherein an opening is formed in the wall of said guide member to face toward the valve member for washing the interior of the guide member.

5. A fluid passage change over valve unit as recited in claim 2 or 3, further comprising joint members for fastening said guide members to the valve member.

6. A fluid passage change over valve unit as recited in claim 5, wherein an opening is formed in the wall of each said guide member to face toward the valve member for washing the interior of the guide member.

7. A fluid passage change over valve unit as recited in claim 2 or 3, wherein said guide members each comprises two halves, one of which is formed integrally with the valve member and the other one of which is fastened to the one half to form the pipe.

8. A fluid passage change over valve unit as recited in claim 7, wherein an opening is formed in the wall of each said guide member to face toward the valve member for washing the interior of the guide member.

9. A fluid passage change over valve unit as recited in claim 7, wherein a lower cover is provided for the lower portions of said guide members and said valve member to cover the gaps therebetween along a swing locus of the lower portion of the valve member.

10. A fluid passage change over valve unit as recited in claim 9, further comprising an upper cover provided for the upper portions of said guide members and the valve member to cover the gaps therebetween along a swing locus of the upper portion of the valve member, and a pair of end covers to close the opposite ends of the upper and lower covers, whereby water tight closed spaces are formed between the valve member and said guide members.

11. A fluid passage change over valve unit as recited in claim 1, wherein each said guide member has a trough shape.

12. A fluid passage change over valve unit as recited in claim 2, 3, or 11, wherein a lower cover is provided for the lower portions of said guide members and valve member to cover the gaps therebetween along a swing locus of the lower portion of the valve member.

13. A fluid passage change over valve unit as recited in claim 12, further comprising an upper cover provided for the upper portions of said guide members and the valve member to cover the gaps therebetween along a swing locus of the upper portion of the valve member, and a pair of end covers to close the opposite ends of the upper and lower covers, whereby water tight closed spaces are formed between the valve member and said guide members.

* * * * *